US005190237A

United States Patent [19]

Fagan

[11] Patent Number: 5,190,237

[45] Date of Patent: Mar. 2, 1993

[54] KITE REEL HAVING CLUTCH AXIALLY ENGAGEABLE TO AN ELECTRIC SCREWDRIVER

[76] Inventor: William E. Fagan, 9 Longfellow Rd., Arlington, Mass. 02174

[21] Appl. No.: 863,034

[22] Filed: Apr. 3, 1992

[51] Int. Cl.[5] ..... B65H 75/40; F41J 9/08

[52] U.S. Cl. ..... 242/96; 192/67 R; 244/155 A

[58] Field of Search ..... 242/96, 225, 250; 192/67 R; 81/57.43, 475; 244/155 R, 155 A; 254/362

[56] References Cited

U.S. PATENT DOCUMENTS

| | | | |
|---|---|---|---|
| 1,196,839 | 9/1916 | Bodene | 192/67 R |
| 1,855,456 | 4/1932 | Miller | 81/475 |
| 3,202,378 | 8/1965 | Williamson | 242/96 X |
| 3,593,940 | 7/1971 | Stanton | 244/155 A X |
| 4,168,042 | 9/1979 | Joe et al. | 242/96 X |
| 4,493,462 | 1/1985 | Ditton | 242/96 |
| 4,915,320 | 4/1990 | Neal | 242/250 |
| 4,962,901 | 10/1990 | Shirley et al. | 242/250 X |
| 5,056,732 | 10/1991 | Nicholson, Jr. | 242/96 X |
| 5,071,085 | 12/1991 | Beers | 242/96 |
| 5,094,330 | 3/1992 | Lee | 81/475 X |

*Primary Examiner*—Daniel P. Stodola
*Assistant Examiner*—John F. Rollins
*Attorney, Agent, or Firm*—William Nitkin

[57] ABSTRACT

A kite reel operable by an electric screwdriver, such reel having a spool with bowl-shaped flanges at both ends, such spool being hollow to receive the screwdriver at one end thereof, which screwdriver can be engaged to rotate the spool or disengaged to allow its free rotation. An axially movable handle is provided to couple or uncouple the screwdriver drive shaft from the reel.

1 Claim, 4 Drawing Sheets

KITE REEL HAVING CLUTCH AXIALLY ENGAGEABLE TO AN ELECTRIC SCREWDRIVER

BACKGROUND OF THE INVENTION

1. Field of the Invention

The device of this invention resides in the field of reels having string spooled thereon and more particularly relates to a motorized kite reel.

2. Description of the Prior Art

Kite reels are well known in the prior art. Some kite reels can be as simple as a spool on which one can wind and unwind the kite string by hand. Others provide a spool with a crank for more easily rotating the spool to play out or rewind the kite string. The inventor herein is the owner of U.S. Pat. No. 3,630,464 for a Reel Device which includes handles located on the axis of a reel adapted to be grasped by the operator's left and right hand, respectively with one of the handles being attached to the reel by a mechanism such that by the movement of that handle along the axis of the reel, the reel is rotated to wind up the kite string.

SUMMARY OF THE INVENTION

The inventor herein has continued his work in the field of kite reels and has developed a motorized kite reel which utilizes an electric screwdriver as the motor for the winding and playing out of the kite string.

Motorized screwdrivers are well known in the art and often contain rechargeable batteries so that no external power supply is needed during operation. Electric screwdrivers operate both in a forward and reverse direction. Electric screwdrivers are generally elongated, cylinder-shaped devices having a handle at one end and have extending out of the other end a rotating shaft with a hex-shaped aperture therein which aperture receives the tool, such as a screwdriver bit, to be driven by the electric screwdriver. In the device of this invention an open, cylindrical collar member is first slid over the front of the cylindrical body of the screwdriver which collar member acts as a low-frictional bearing for the rotating reel of this invention. The reel of this invention has a central hollow spool, being open at one end with two outwardly extending, open-ended side members which are substantially bowl-shaped and large enough to receive the user's closed hand therein positioned at each end of the spool as will be described further below. The kite string is coiled around the spool. Within the spool's open end is inserted the electric screwdriver carrying the cylindrical collar member which electric screwdriver passes through the spool to its opposite side where there is a wall member. Extending from the wall member is a hollow receipt member having at the end thereof a hex receipt aperture. A separate handle member is provided through which extends an independently rotatable handle shaft. Formed at the inner end of the handle shaft is a hex member which has a narrowed portion of smaller diameter than the diameter of the hex member disposed along its length. The handle freely rotates on the handle shaft.

In use, one fits the electric screwdriver with its collar member thereon into the open end of the spool so that the end of the electric screwdriver's shaft mates against the end of the hollow receipt member, aligning its hex receipt aperture with the hex-shaped aperture at the end of the screwdriver's shaft. The user then inserts the hex member of the handle shaft within the handle into the hex receipt aperture of the hollow receipt member and then aligns and inserts it further into the hex-shaped opening in the drive shaft of the screwdriver. When the screwdriver is thus positioned and is activated to forward drive, the handle shaft is rotated in a forward manner and, depending upon which hand holds it, the spool is then rotated either to wind or play out the kite string positioned on the spool. By depressing the reverse button on the electric screwdriver, the spool is then rotated in the other direction. It should be noted that the device of this invention can be used by both right-handed and left-handed users depending upon which hand the user chooses to hold the handle and which hand holds the electric screwdriver. If one wishes to have the string of the kite freely come off the spool and for the spool to rotate freely on the collar member without engagement with the electric screwdriver, one can pull the handle shaft slightly outward. This lateral movement causes the end of the hollow receipt member to align the hex receipt aperture over the narrow diameter groove on the handle shaft such that there is no engagement between the end of the hollow receipt member and the handle shaft, allowing the spool to spin freely. In some instances such lateral movement can serve to disconnect the screwdriver's internal clutch, also allowing for free rotation of the spool. If one wishes to re-engage the spool to the electric screwdriver, one can merely push the handle inward enough so that the hex receipt aperture of the hollow receipt member of the spool is then engaged on the hex member at the end of the handle shaft which positioning then re-engages the electric screwdriver to drive the spool in the direction desired.

In one embodiment of the device of this invention a handle collar can be utilized over the hollow receipt member and when thus positioned, the handle collar can act as a bushing. The handle collar can extend up into a hollowed portion of the handle in some embodiments.

DESCRIPTION OF THE PREFERRED EMBODIMENT(S)

Figure 1:
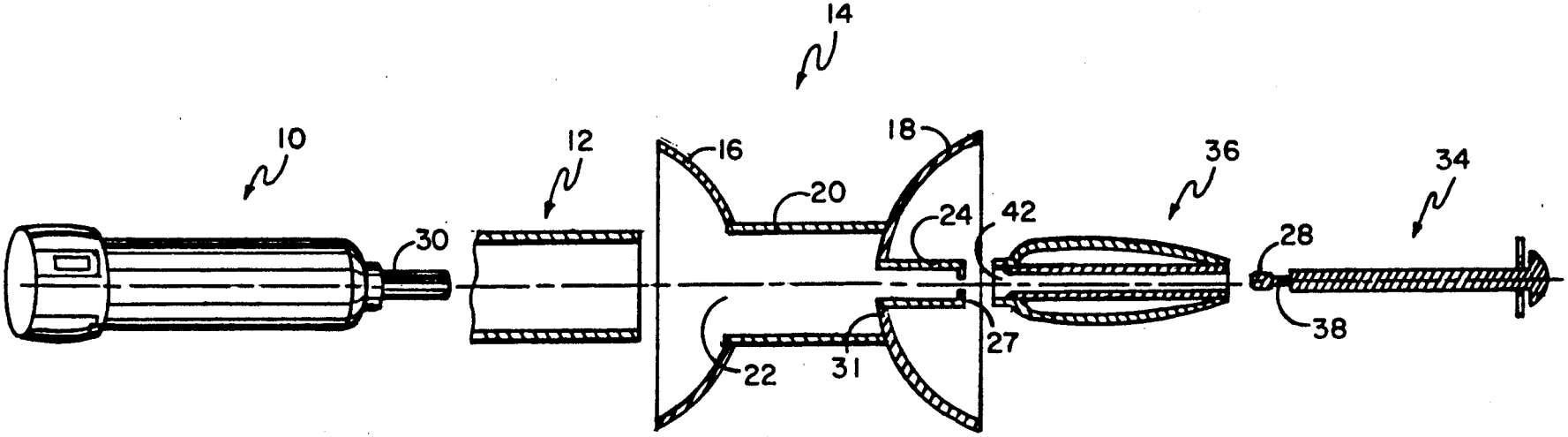
FIG. 1 illustrates an exploded, cross-sectional view of the kite reel of this invention.
Figure 2:
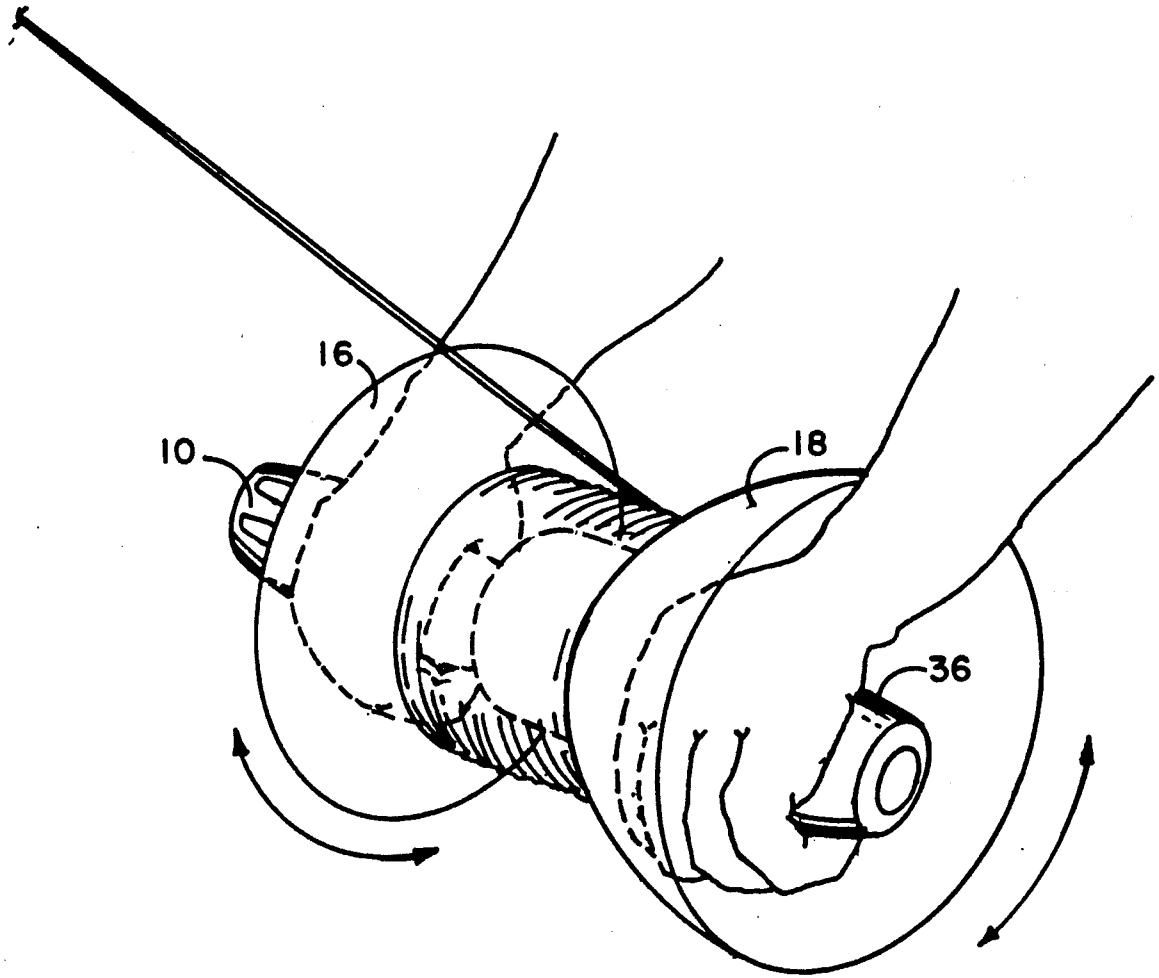
FIG. 2 illustrates a perspective view of the kite reel of this invention in use.
Figure 3:
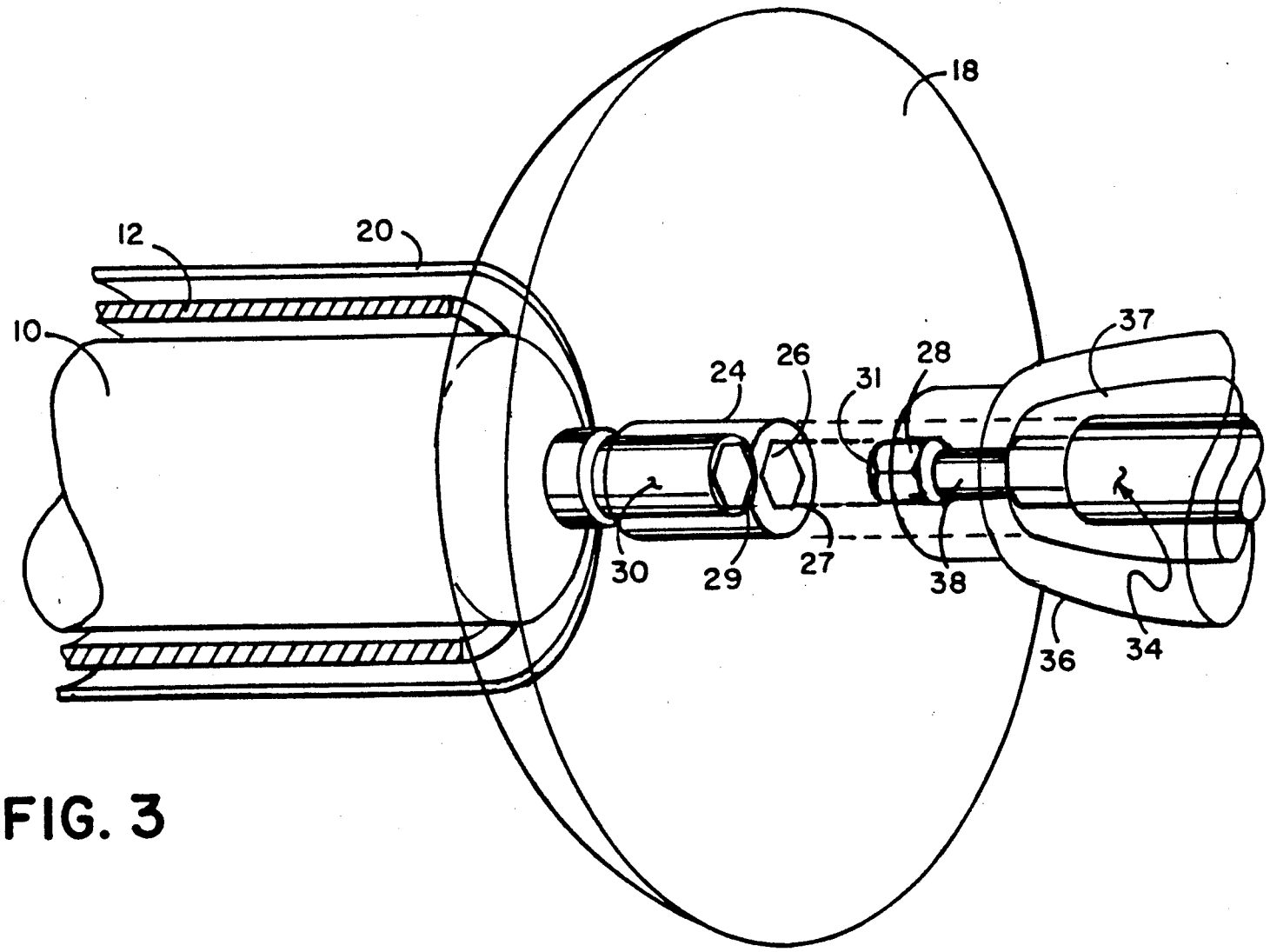
FIG. 3 illustrates a close-up, perspective view of the hollow receipt member with the electric screwdriver shaft positioned therein about to be engaged with the hex member of the handle shaft.
Figure 6:
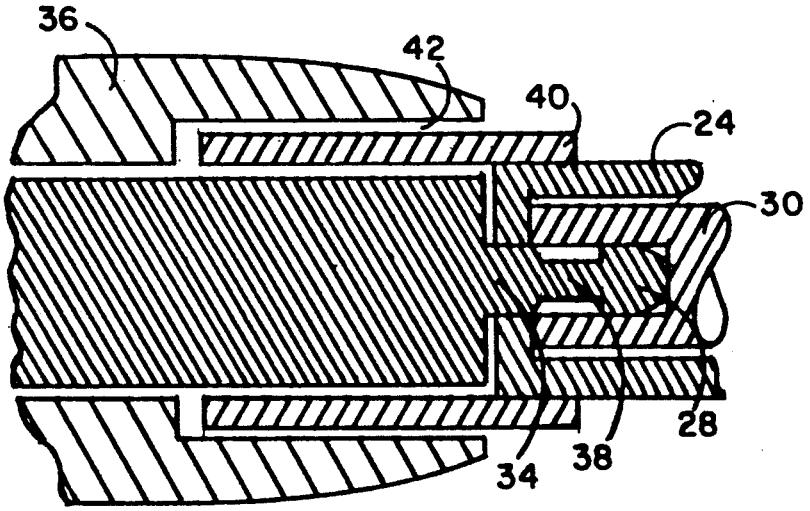
FIG. 6 illustrates a cross-sectional view of the handle collar positioned around the handle shaft and hollow receipt member.

FIG. 1 illustrates an exploded cross-sectional view of the kite reel of this invention. Seen in this view is electric screwdriver 10 having collar 12 positioned therearound which collar is an open cylinder adapted to fit over the end of the screwdriver and also to fit in a rotating relationship within entry area 22 of spool 14 such that spool 14 can rotate freely at the end of electric screwdriver 10. Spool 14 has two enlarged hollow flanges 16 and 18 which are bowl-shaped with their openings facing outward from the central string-covered spool core 20. These bowl-shaped, hollow flanges 16 and 18 partially encircle the hands of the user and help make the device of this invention easy to manipulate. At the opposite end of the spool from entry area 22 is spool wall 31 from the center of which extends hollow receipt member 24 which extends to end wall 27 having hex receipt aperture 26 defined therein. When electric screwdriver 10 is inserted fully into entry area 22, hex aperture 29 of screwdriver shaft 30 is disposed against the inside of end wall 27 of hollow receipt member 24 as seen in FIG. 3. Mating into hex receipt aperture 26, when the device is in use, is hex member 28 on the end of handle shaft 34 which is freely rotatable within handle 36. Hex member 28 is disposed in two portions, the inner hex portion 33 and outer hex portion 35 with groove 38 formed therebetween. Handle shaft 34 rotates freely within handle 36 which handle is held stationary by the user as seen in FIG. 2. Shaft 34 has a head 37, as seen in FIG. 1, to retain handle 34 thereon. In some embodiments, as seen in FIG. 6, a collar member 40 can be slipped over hollow receipt member 24 and can extend into collar receipt area 42 defined in handle 36.

In use, the kite reel of this invention has kite string wrapped around its central spool core 20 which string, depending on the direction of rotation of the spool, can be either wound or unwound on the spool core. If one desired to wind the spool, assuming that electric screwdriver 10 is held in the left hand, one would depress the forward button on the electric screwdriver and the spool would wind up the kite string because outer hex portion 35 of hex member 28 is engaged through hex receipt aperture 26 in hex aperture 29 of screwdriver shaft 30. Inner portion 33 of hex member 28 then engages with hex receipt end wall 27 and driveably attaches spool 14 to the end of screwdriver shaft 30, allowing the rotation of screwdriver shaft 30 to drive spoolx 14.

Figure 4:
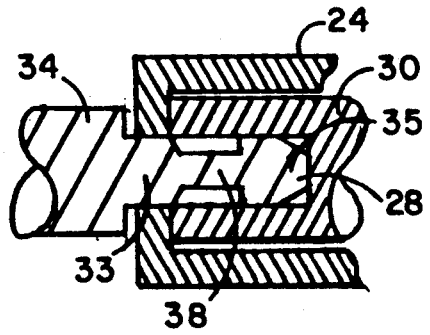
FIG. 4 illustrates a cross-sectional view of the hex member engaged in the hex aperture of the electric screwdriver shaft.
Figure 5:
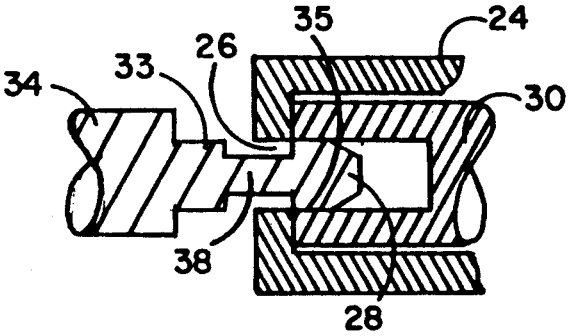
FIG. 5 illustrates a cross-sectional view of the spool unengaged with the electric screwdriver showing the hex receipt aperture of the hollow receipt member positioned adjacent to the groove in the handle shaft.

The mechanism to release the engagement of spool 14 with screwdriver shaft 30 is illustrated in more detail in FIGS. 4 and 5. FIG. 4 illustrates the engagement mode while FIG. 5 illustrates the embodiment showing the spool's non-engagement mode where the spool is released rom engagement with the electric screwdriver. One can pull handle 36 outward slightly which action causes hex receipt aperture 26 of hollow receipt member 24 to be moved laterally beyond the engaging edges of inner portion 33 of hex member 28 on handle shaft 34 so that hex receipt aperture 26 of end wall 27 is then disposed around groove 38. In this position nothing is engaged against end wall 27 of hollow receipt member 24, and spool 14 is freely able to rotate in any direction which ability is useful, for example, when the kite string is unreeling at a rate determined by the kite's pull.

The device of this invention utilizes a conventional electric screwdriver of which there are many brands available. Electric screwdrivers are often interchangeable because many have the same conventional end construction in order to utilize the same interchangeable tools. By utilizing the mechanism of this invention, one can easily operate a large spool sensitive to a string's winding and playing out action without the need for extensive hand manipulation. With the device of this invention only a slight lateral movement of the hand is necessary to either engage or disengage the spool from the electric screwdriver motor.

Although the present invention has been described with reference to particular embodiments, it will be apparent to those skilled in the art that variations and modifications can be substituted therefor without departing from the principles and spirit of the invention.

I claim:

1. In a kite reel for use on a kite of the type having a string attached thereto, the combination comprising:

an electric screwdriver having first and second ends having a handle at its first end, said screwdriver being of the cylindrical type having a drive shaft extending from its second end, said drive shaft having a hex aperture defined in the end thereof;

a spool member having a hollow core and first and second ends;

first and second open, bowl-like, flared hollowed flanges, one positioned at each end of said spool member, each flange having its opening aimed outward, said string adapted to be wrapped around the core of said spool member between said flanges;

a wall disposed at the first end of said spool member;

a cylindrical collar member adapted to fit over the second end of said screwdriver, said collar member being of a size to fit in the second end of said spool member, the second end of said spool member being open to allow the free rotation of said spool member on said electric screwdriver;

a hollow receipt member positioned at the center of said wall adapted to receive the drive shaft of said electric screwdriver;

a hex receipt aperture defined at the end of said hollow receipt member alignable with said hex aperture defined in the drive shaft of said screwdriver;

a handle having an aperture defined therein; and a handle shaft, having a first and second end, said shaft rotatably disposed within said handle aperture, said handle shaft having at its first end means to prevent its further insertion into said handle member and having at its second end a hex member adapted to be positioned into said hex receipt aperture of said hollow receipt member and said hex aperture of said drive shaft of said electric screwdriver, said handle shaft further including a groove defined therein immediately adjacent to said hex member, said handle shaft provided such that when said hex member is engaged through said hex receipt aperture into said hex aperture of said handle shaft, said spool member is driven in the direction of the rotation of said electric screwdriver; and when said handle shaft is manually pulled by the operator such that said hex receipt aperture of said hollow receipt member is aligned with said groove in said handle shaft, said spool member is allowed to freely rotate on said collar member such that the electric screwdriver's rotating drive shaft does not drive or engage said spool member, allowing the free playing out of string from said spool member.

* * * * *